United States Patent [19]

Swigert et al.

[11] 4,196,422

[45] Apr. 1, 1980

[54] INTRUSION ALARM SYSTEM

[75] Inventors: David L. Swigert; Ronn G. Smith, both of Ft. Collins, Colo.

[73] Assignee: Teledyne Industries, Inc., Ft. Collins, Colo.

[21] Appl. No.: 866,789

[22] Filed: Jan. 3, 1978

[51] Int. Cl.[2] ..... E05B 45/06; E05B 45/12; G08B 13/08

[52] U.S. Cl. ..... 340/542; 340/541; 340/545; 340/549; 200/44; 200/61.64; 200/61.67; 70/432; 70/439

[58] Field of Search ..... 340/542, 549, 541, 384 E, 340/545; 200/61.64, 61.67, 61.73, 61.39, 44; 70/432, 433, 439, 438; 92/5 L

[56] References Cited

U.S. PATENT DOCUMENTS

| | | | |
|---|---|---|---|
| 1,160,496 | 11/1915 | Casper | 340/542 |
| 2,874,240 | 2/1959 | Ricks | 200/44 |
| 3,259,707 | 7/1966 | Eickhoff | 200/61.67 |
| 3,487,404 | 12/1969 | Midkiff | 340/384 E |
| 3,676,617 | 7/1972 | Miller | 200/44 |
| 3,693,110 | 9/1972 | Briggs et al. | 340/384 E |
| 3,828,340 | 8/1974 | Bauer et al. | 340/542 |
| 3,866,164 | 2/1975 | Peterson | 340/545 |
| 3,939,315 | 2/1976 | Schlage | 200/61.67 |

*Primary Examiner*—John W. Caldwell, Sr.
*Assistant Examiner*—Donnie L. Crosland
*Attorney, Agent, or Firm*—Hugh H. Drake

[57] ABSTRACT

A lock mechanism is included within the outer knob of a latch assembly. Associated with the inner knob is an alarm apparatus that includes a battery, a sound generator and a transducer for delivering an audible signal. The different components of the alarm apparatus are located either in an escutcheon associated with the inner knob or within the body of the knob itself. In either case, the latch assembly includes switch contacts which close to operate the alarm apparatus upon a very slight twisting of the outer knob.

30 Claims, 39 Drawing Figures

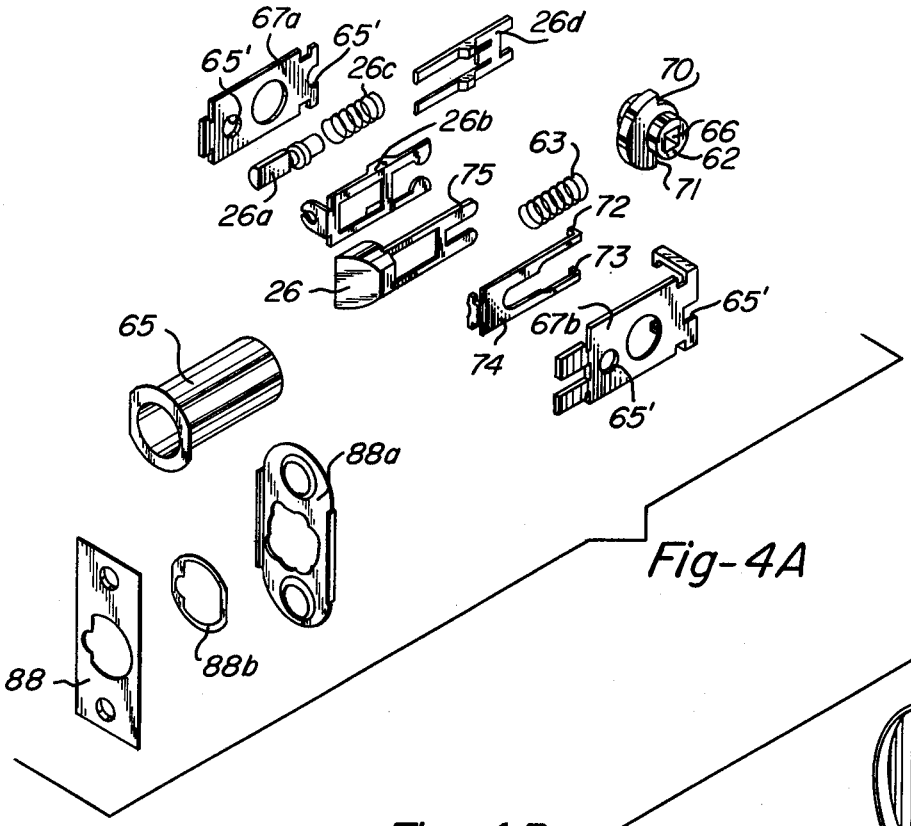
Fig-4A
Fig-4B
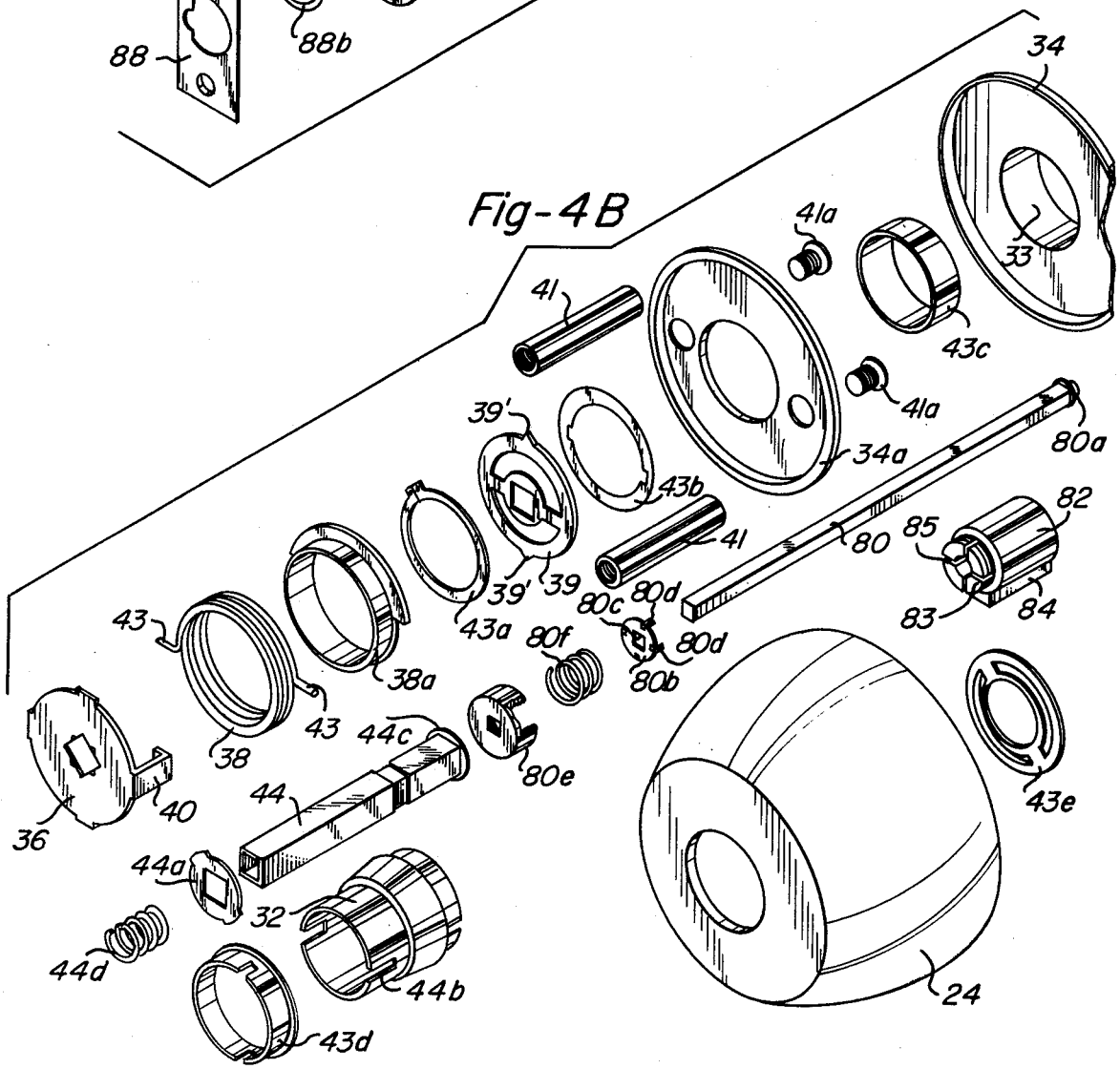

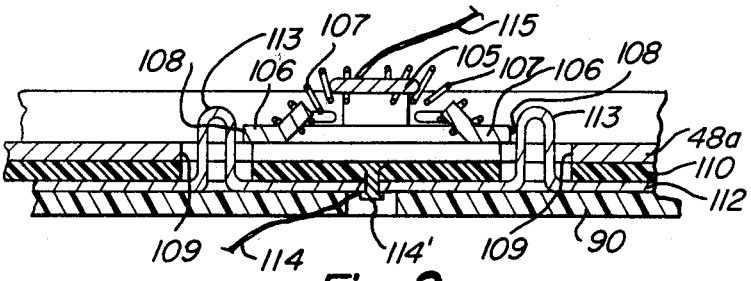
Fig-8
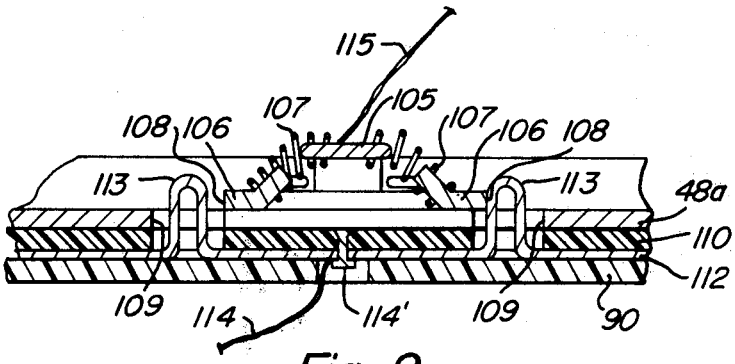
Fig-9
| 164 | 166 | RATE Hz |
|---|---|---|
| O | O | 0 |
| O | C | 10 |
| C | O | 1.25 |
| C | C | (See diagram) |
Fig-14

INTRUSION ALARM SYSTEM

The present invention pertains to an intrusion alarm system. More particularly, it relates to an alarm system effective without the need for actual intrusion.

A wide variety of intrusion alarm systems are known. For guarding the security of enclosed structures having doors, windows and the like, one widely-employed system includes continuous wires taped to all window surfaces and in circuit with contacts installed in all closures such as doors. Any break in the circuit, as by opening a door or fracturing a window, results in the sounding of an alarm. Other systems have used light beams aimed at photocells, sensitive infrared detectors, pressure detectors and ultrasonic fields. In all of those approaches, an intruder disturbs a quiescent condition, and that disturbance causes an alarm signal to be developed.

One characteristic common to at least most prior intrusion alarm systems is that the act of intrusion has to occur in order to sound the alarm. That is, a door has been opened or a window has been broken in the case of a building. Of course, theft is one usual motive for breaking and entering. At other times, there is an intent to do bodily harm to an occupant. However, there also are many other unauthorized or even accidental entries. These may include vandalism and other so-called nuisance crimes. Other nuisance intrusions might include a drunken neighbor, a distraught lover, a mistaken realtor and so forth. In any case, it has been estimated that there were 1.6 million residential burglaries in 1976. From that, it has been concluded that, over a ten-year span, one out of five households can expect to be burglarized. Add to that the nuisance intrusions, and it might be expected that, for all unauthorized intrusions, every residence can, on average, expect to be trespassed upon in a ten-year period of time. However accurate such estimates may be, it is clear that protection against intrusion would be a desirable feature in every household, let alone in business establishments. Yet, most intrusion alarm systems presently available are quite expensive for purchase by the average homeowner or small businessman.

It is, accordingly, a general object of the present invention to provide a new and improved intrusion alarm system which is advantageous in overcoming some of the above-mentioned deficiencies of prior systems.

Another object of the present invention is to provide a new and improved intrusion alarm system which aids in the prevention of nuisance crimes and other such intrusions as well as in warding off the deliberate criminal.

A further object of the present invention is to provide a new and improved intrusion alarm system which is capable of being used without any necessity to modify existing structures.

Still another object of the present invention is to provide a new and improved intrusion alarm system that does not rely upon connection to commercial power sources or require any type of wiring.

A still further object of the present invention is to provide a new and improved intrusion alarm system which effectively prevents an intended intrusion prior to the actual act of intrusion.

In such an intrusion alarm system, a closure has a latch assembly that includes a knob on one side of the closure for enabling opening of the closure as a result of operation of the assembly. The operation requires physical action by a person with respect to the knob. A lock mechanism is included within the knob and is selectively operable to lock or unlock the latch assembly. An alarm apparatus associated with the latch assembly is disposed on the side of the door opposite the one side and includes a battery, a generator powered by the battery and responsive to an input signal for developing a sound signal, and a transducer that responds to the sound signal for delivering an audible warning signal. Finally, there is included means responsive to the physical action for delivering the input signal to the generator.

The features of the present invention which are believed to be novel are set forth with particularity in the appended claims.

The organization and manner of operation of the invention, together with further objects and advantages thereof, may best be understood by reference to the following description taken in connection with the accompanying drawings, in the several figures of which like reference numerals identify like elements, and in which:

FIG. 4A is an exploded perspective view of a sub-assembly shown in FIG. 4;

FIG. 4B is an exploded perspective assembly view of another sub-assembly shown in FIG. 4;

FIG. 8 is a fragmentary cross-sectional view taken along the line 8—8 in FIG. 6, parts therein being positioned for the open condition of a switch mechanism;

FIG. 9 is a view similar to FIG. 8 but illustrates a different positioning of certain parts so as to achieve a condition of closure of a switch mechanism;

FIG. 14 is a truth table for the operation of the embodiment of FIG. 12;

Figure 1:
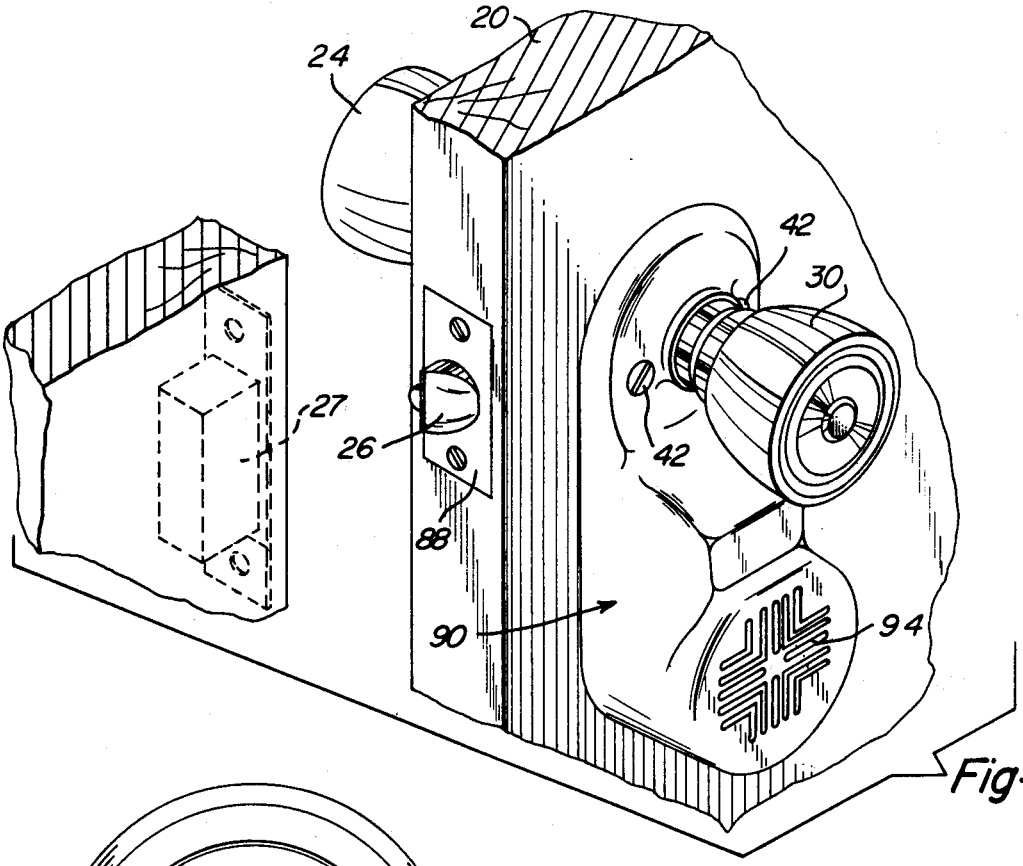
FIG. 1 is a fragmentary perspective view of a first embodiment of an intrusion alarm system installed on a door and with a doorjamb moved away from the edge of the door.
Figure 2:
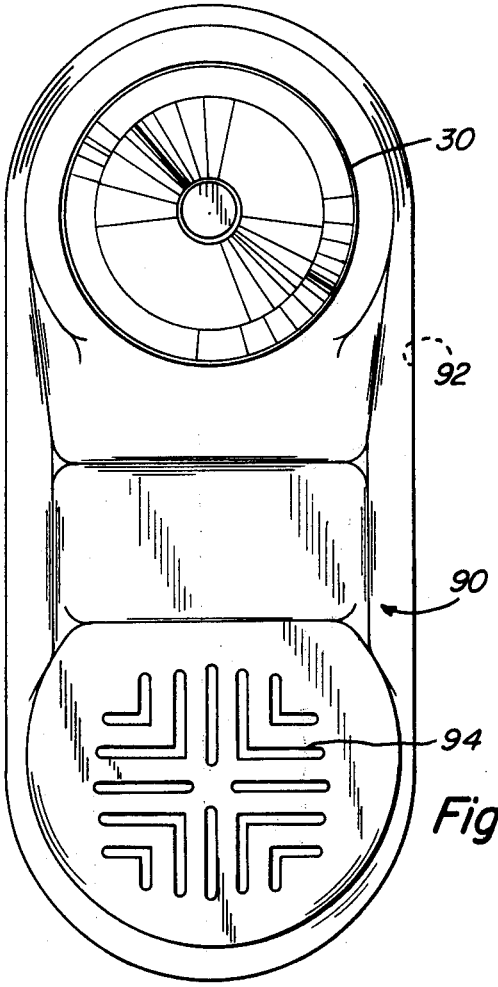
FIG. 2 is a front-elevational view of a portion of the components shown in FIG. 1.
Figure 3:
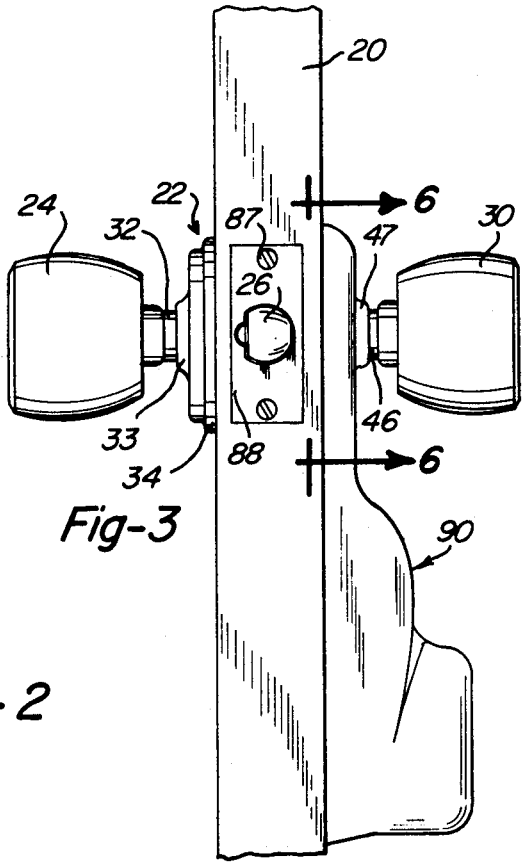
FIG. 3 is a side-elevational view of the door and alarm system as shown in FIG. 1.
Figure 7:
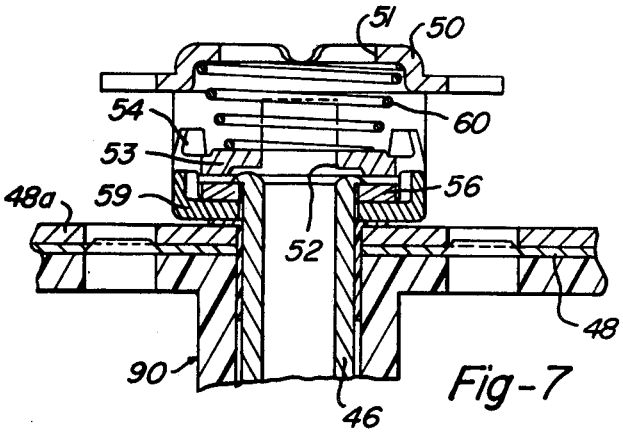
FIG. 7 is a fragmentary cross-sectional view taken along the line 7—7 in FIG. 6.

The version of FIGS. 1-9 illustrates a first embodiment of an intrusion alarm system mounted upon a closure such as a door 20. A latch assembly 22 has a knob 24 on one side for enabling opening of the door as a result of operation of the latch assembly. That operation requires physical action by a person with respect to the knob; in this case, the latch assembly is of a type in which the knob must be rotated in order to cause withdrawal of a latch bolt 26 which normally projects from the edge portion of the door into engagement with an opening in a latch plate 27 affixed to the adjacent portion of the doorjamb.

Included within knob 24 is a lock mechanism 28 selectively operable to lock and unlock latch assembly 22. In this case, lock mechanism 28 has a cylindrical tumbler-type locking element of a conventional nature and operable by means of the insertion of a key 29 within a longitudinal slot therein.

On the other side of door 20 is a second knob 30 which similarly may be grasped and rotated so as to operate the latch assembly and cause withdrawal of latch bolt 26. In a well-known manner, knob 30 also is so associated with latch assembly 22 as also to enable operation of lock mechanism 28 from the side of door 20 on which knob 30 is located. As illustrated, latch assembly 22 is of one conventional kind in which knob 20 may be pressed inwardly and slightly twisted so as to achieve locking or rotated slightly in the opposite direction and allowed to move outwardly for the purpose of unlocking. Thus, knob 24 normally would be located on the outside of door 20 and be locked and unlocked by means of key 29. On the other hand, knob 30 normally would be located on the inside of door 20 and be manually manipulable to lock and unlock the door.

Figure 4:
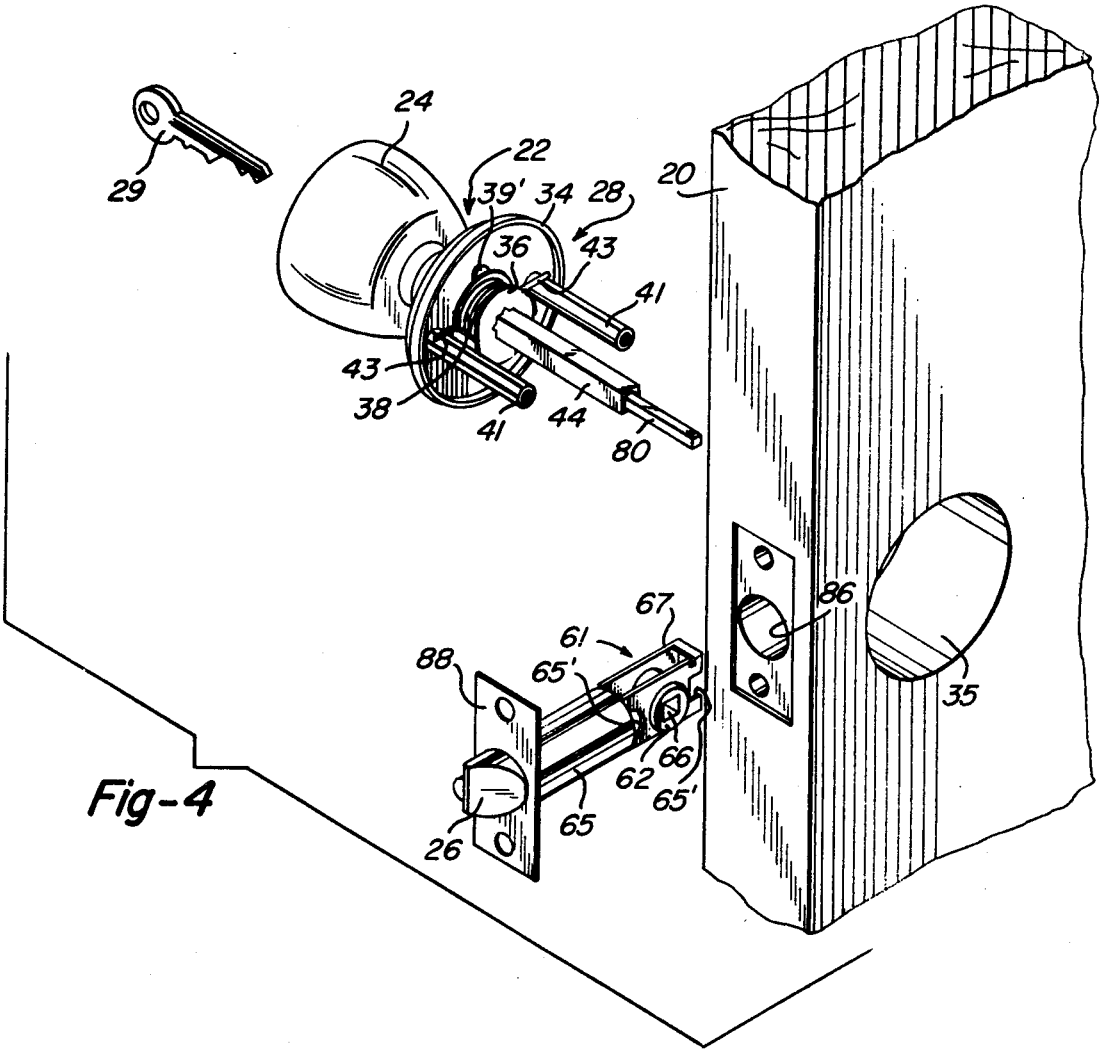
FIG 4 is an exploded perspective view of a portion of that which is included in FIG. 1.
Figure 4C:
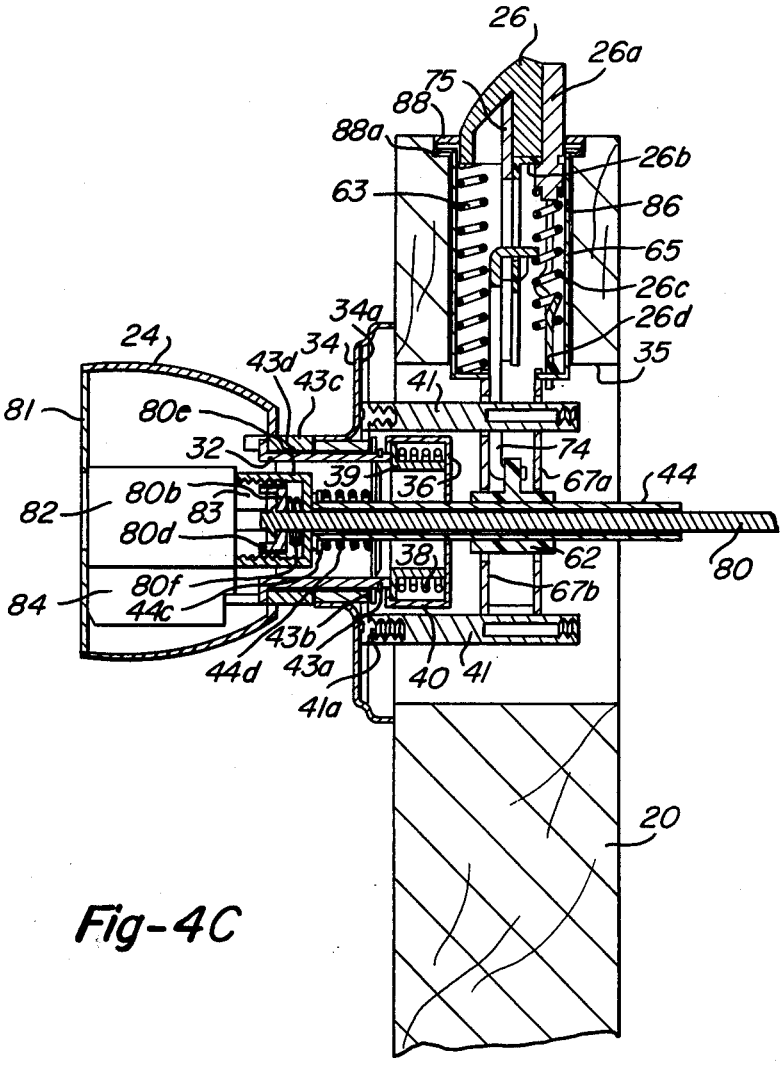
FIG. 4C is a fragmentary cross-sectional view of the principal components shown in FIG. 4 when assembled and looking downwardly along the longitudinal axis of the sub-assembly of FIG. 4A.
Figure 5:
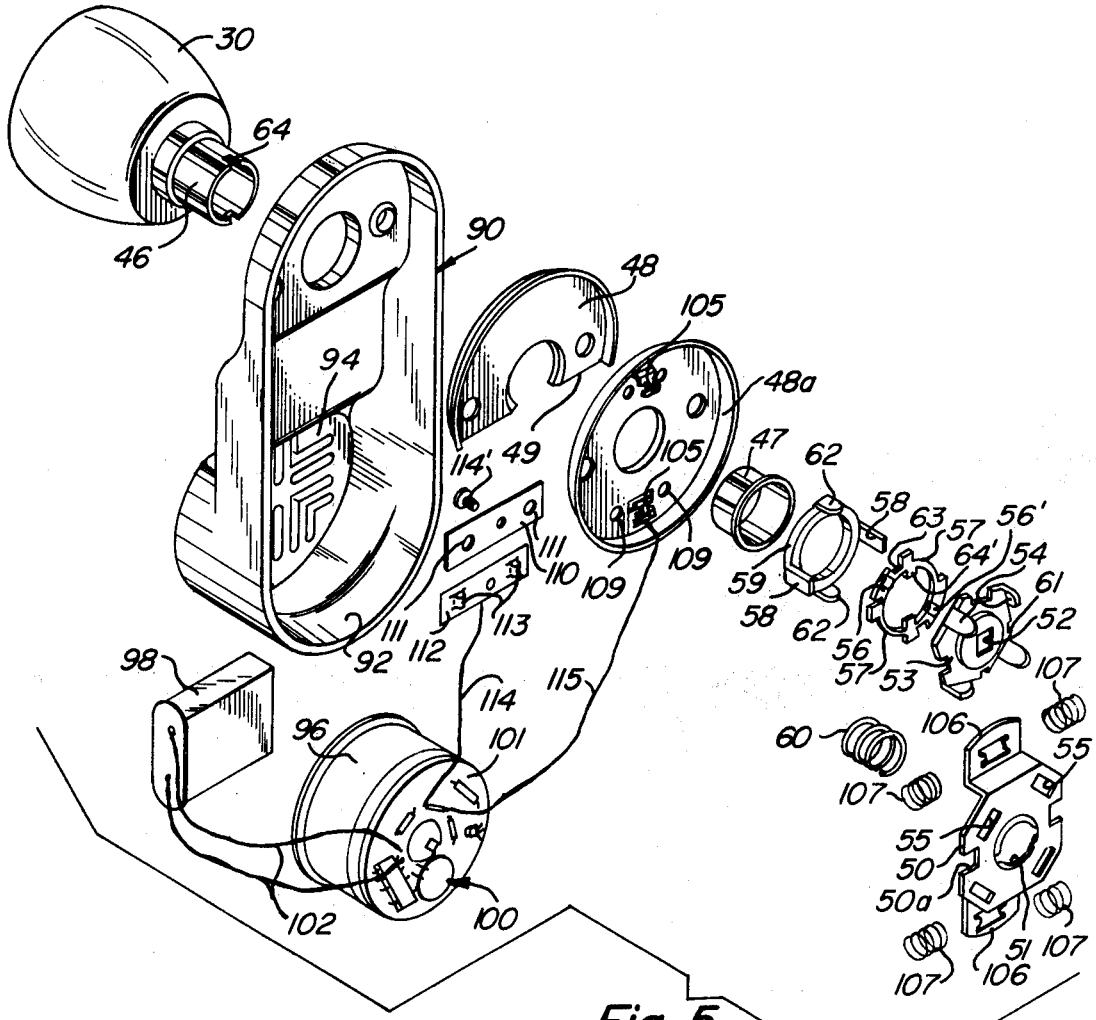
FIG. 5 is an exploded perspective view of another portion of that which is shown in FIG. 1 and reversed in generally horizontal position.
Figure 6:
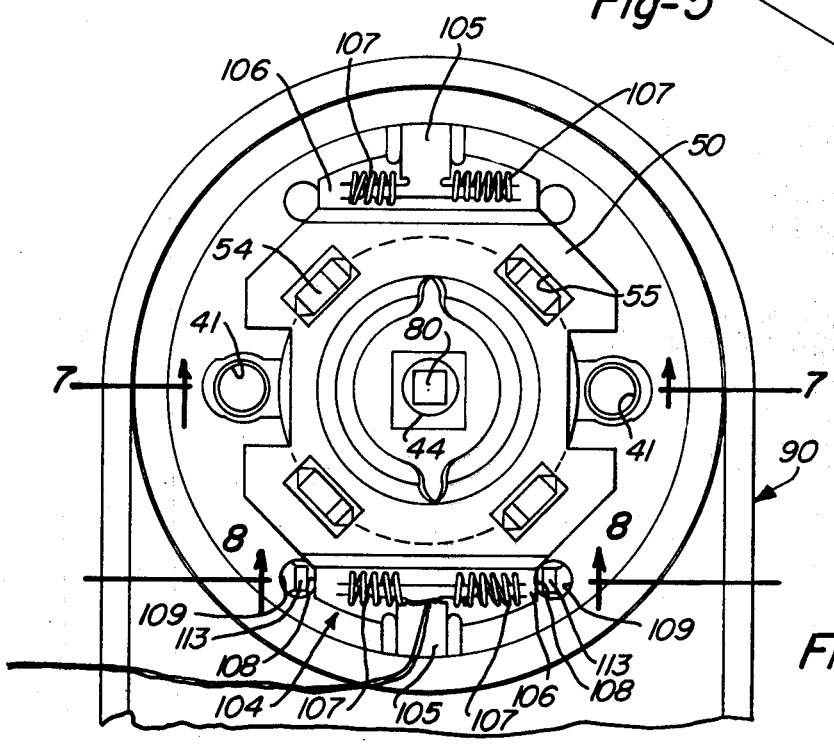
FIG. 6 is an enlarged fragmentary cross-sectional view taken along the line 6—6 in FIG. 3.

In more detail as to the structure of latch assembly 22 and locking mechanism 28, a shank 32 projects from knob 24 and is received within an outwardly projecting boss 33 of a cover plate 34 which conceals an opening 35 formed through the thickness of door 20. The inner end portion of shank 32 is fixedly coupled to a basket 36 which captivates a coil spring 38 on a collar 38*a*. Spring 38 is positioned between basket 36 and a plate 39. Plate 39 is affixed to basket 36 by means of lugs 40. Projecting inwardly from a mounting plate 34*a* nested within cover plate 34 are a pair of space-opposed sutds 41 internally threaded to receive screws 42 extending from an internal knob assembly yet to be described. Studs 41 are secured by screws 41*a* that extend through plate 34*a*. A pair of space-opposed ears 39' on plate 39 engage the outer side walls of studs 41 so as to limit rotation of shank 32 and thus of knob 24. Individual outwardly-directed end portions 43 of spring 38 are engageable respectively against studs 41, so as to cause knob 24 to assume a nominal center position with regard to rotation. Completing this portion of the assembly as illustrated in FIGS. 4B and 4C, there also are a split ring 43*a*, a washer 43*b*, a plain collar 43*c*, a flanged collar 43*d* and a retainer ring 43*e* over which shank 32 is peened for securement to knob 24.

A squared shaft 44 projects inwardly through the just-described components and is captivated by similarly-squared openings in basket 36 and plate 39 as well as in a collar 44*a* having lugs which engage slots 44*b* in shank 32, so that shaft 44 has to rotate when knob 24 is rotated. The exterior end of shaft 44 has a flange 44*c*, and a compression spring 44*d* encircles shaft 44 and is disposed between flange 44*c* and plate 39. Shaft 44 has limited spring-biased longitudinal movement.

The mating half of the total lockset includes knob 30 with its own shank 46 journalled within a bushing 47 within an internal cover plate 48. The pair of screws 42 are insertable through openings in cover plate 48 and threadable into studs 41 so as to clamp cover plates 34 and 48 against door 20 with shaft 44 running therethrough. A lower segment of cover plate 48 is cut away, as at 49, for reasons which will become apparent. Cover plate 48 and an included mounting plate 48*a* receive bushing 47.

Captivated on the underside of mounting plate 48*a* disposed inside cover plate 48 is a bracket 50 which has a central opening 51 accommodating receipt of shaft 44 through a centrally-located squared opening 52 in a locking plate 53 which has a plurality of circumferentially-spaced upstanding projections 54 matingly receivable within similarly circumferentially-spaced openings 55 surrounding opening 51 in bracket 50. Underlying locking plate 53 is a cam plate 56 which has cutouts 57 through which may be received lugs 58 projecting theretoward from a washer 59. Compressed between locking plate 53 and the underside of bracket 50, surrounding opening 51, is a spring 60. Lugs 58 are of a length so as also to extend to a position within recesses 61 in plate 53 at all times. Shorter lugs 62 project from washer 59 so as to be engageable with recesses 63 spaced around plate 56. Shank 46 is splined as at 64 so as to mate with and be secured to internal nubs 64' on plate 56 and drive the assembly in rotation upon turning of knob 30. Detents 56' in plate 56 cooperate with lugs 62 to rest rotation of knob 30 in one position. Recesses **50*a* in bracket 50 seat loosely around studs 41, so as to permit limited rotation of bracket 50 relative to mounting plate 48*a***.

With shank 46 withdrawn with respect to bushing 47, rotation of knob 30 causes corresponding rotation of all of locking plate 53, cam plate 56 and washer 59 so as to enable movement of latch bolt 26 through shaft 44. In itself, latch bolt 26 includes a conventional rotational-to-reciprocation operating mechanism 61 which includes a collar 62 internally defined rectangularly to receive shaft 44 and coupled to cause reciprocation of latch bolt 26 upon knob rotation, the latch bolt being biased outwardly by the inclusion of an internal spring 63.

Latch bolt 26 is slidably receivable within a barrel 65 and is normally urged outwardly by the internally captivated compression spring 63. A bracket 67, composed of parts **67*a* and 67*b*, projects inwardly of the door edge margin from the inner end of barrel 65 and supports collar 62 for rotation about its longitudinal axis. Openings 65' accommodate studs 41. Formed interiorly of collar 62 is a square opening 66 that receives shaft 44. Projecting outwardly from collar 62 are a pair of pawls 70 and 71 which are engageable with respective lugs 72 and 73 on a slip follower 74 that engages a strip 75 which projects inwardly from latch bolt 26. Rotation of shaft 44 by movement of either knob 24 or knob 30 serves through the pawls and lugs to cause withdrawal of the latch bolt and permit opening of the door. Also included in the version shown is a deadlatch 26*a* carried on a guide 26*b* and mounted by a compression spring 26*c* from a support 26*d*. Barrel 65 is supported from a plate 88 by a bracket 88*a* secured thereto and sandwiching a washer 88*b***.

As such, the entire normal operation of the latching mechanism is now well known in the art. When unlocked, a twisting of either knob 24 or knob 30 results in a rotation of the entire assembly of washer 59, cam plate 56 and locking plate 53 so as to enable the turning of shaft 44 to operate latch mechanism 61 and work latch bolt 26.

Received within shaft 44 is a lockshaft 80 also of rectangular configuration but rotatable within the bore of shaft 44. Captivated within knob 24 by an ornamental cover 81 is a portion of locking mechanism 28 which includes a sleeve 82 within which is rotatable a cylinder 83. The cooperation of sleeve 82 and cylinder 83 includes the conventional action of spring loaded tumblers within a housing 84 that enables rotation of cylinder 83 only when key 29 properly aligns those tumblers. The outer end of lockshaft 80 is secured to cylinder 83.

In more detail, lockshaft 80 has a flange **80*a* on its outer end against which fits a collar 80*b* that has a central squared opening 80*c* which fits snugly on the lockshaft. Lugs 80*d* project from collar 80*b* into corresponding slots 85 formed in the end of cylinder 83. A cap 80*e* is secured over and compresses a spring 80*f* against collar 80*b*. Shaft 44 is received on lockshaft 80 so that flange 44*c* abuts cap 80*e***.

The other or inner end of lockshaft 80 protrudes within knob 30 where it may be engaged within a semi-square opening in a cross-plate conventionally disposed across the interior of knob 30. The semi-square shape allows knob 30 to be rotated the small amount necessary to lock or unlock lugs 54 from openings 55 and to free lockshaft 80 from that cross-plate. On the other hand, rotation of cylinder 83 by means of key 29 serves through lockshaft 80 to rotate knob 30 in the direction which frees lugs 54 from openings 55 and, thus, unlocks the assembly by freeing all locking parts so that either of knobs 24 and 30 may be turned to operate latch bolt 26 by means of shaft 44. Lockshaft 80 is longitudinally movable within and spring loaded interiorly of shaft 44 so as to be urged toward knob 24. A preferred alternative to the aforementioned cross-plate in knob 30 is shown in FIGS. 24 and 31–34; it will be described further in connection with another embodiment.

In any case, the end of lockshaft 80 within knob 24 is operatively connected with lock cylinder 83. When knob 30 is urged toward door 20 and turned, the entire assembly is locked. Operation of lock cylinder 83 by means of an inserted key, on the other hand, serves to release knob 30 and unlock the assembly.

Nothing in the immediate foregoing description of the lockset itself is presented herein as being novel. Instead, it is only an example of one sort of lockset with which the invention of the present application may be incorporated. In one degree of particularity, however, advantage is taken of this mode of lockset approach in achieving the functions of an alarm switch yet to be described.

As shown and thus far described, the lockset itself is essentially the same as one widely sold under the brand "Weiser". It accommodates standardized placement of openings 35 and 86 in doors. Although differing in certain details of component structure and assembly, other Weiser locksets also are suitable. Such locksets are readily available at hardware stores and contractor supply outlets.

Other latching and locking mechanisms may be employed, and a number are well known. In one conventional approach, a twist knob is disposed centrally in the end wall of knob 30 and may be rotated in one direction or another in order respectively to lock or unlock the latch assembly manually. In any case, that which has been discussed in detail thus far is entirely conventional and is subject to being modified as might be desired, for example, in choosing among the locksets produced by different manufacturers.

As indicated, the form of lockset illustrated is one intended for mounting in openings provided in door 20 of a size and location which has become somewhat of an industry standard. That is, opening 35 extends through the thickness of door 20 so as to accommodate shafts 44 and 80, and that opening is intersected by an opening 86 which serves to receive latch bolt 26. The latch assembly is held in place by a pair of screws 87 which extend from the open jamb side of door 20 through the usually-decorative external cover plate 88 and into the door.

Overlying cover plate 48 is an escutcheon 90. Internally defined with escutcheon 90 is a cavity 92 within which is disposed an alarm apparatus so as to be associated with latch assembly 22 and disposed on the inside of door 20. Formed into the front wall of escutcheon 90 is a grill 94 transmissive of sound developed by a transducer or horn 96 mounted inside grill 94 and thus disposed within cavity 92. Also included within cavity 92 is a battery 98 and a generator 100 powered by battery 98 and responsive to an input signal for developing a sound signal to which transducer 96 responds for delivering an audible warning signal. When assembled, horn 96 faces grill 94, battery 98 rests in cavity 90 above horn 96 and the electronic components of generator 100 are carried by a substrate 101 mounted on the rear surface of horn 96. Conductors 102 lead from battery 98 to substrate 101. Finally, a switch 104 is associated with latch mechanism 22 so as to respond to the physical action of beginning to rotate knob 24 by delivering an input signal to generator 100.

In more detail, bracket 50 is captivated to plate 48*a* in a manner which permits limited rotation of bracket 50 relative to plate 48*a*. Ears 105 projecting from plate 48*a* are bent to overlie lugs 106 that project outwardly from respective opposite sides of bracket 50. Compression springs 107 are secured respectively between a tab on each side margin of ears 105 and a corresponding tab on each side margin of lugs 106. Springs 107 serve to urge bracket 50 to a nominal center position in which the respective side edges 108 of lugs 106 are each approximately aligned over a near marginal portion of a corresponding hole 109 in plate 48*a*. On the other hand, a slight twisting of knob 24, and thus of shaft 44, will cause a like rotation of bracket 50 when lugs 54 are locked into openings 55. That rotation, in either direction, causes a corresponding one of side edges 108 to move substantially over the associated one of holes 109.

Secured as by cementing on the outer side of plate 48*a* is an insulator strip 110 which has openings 111 that match holes 109. Atop strip 110 is a conductive strip 112 that has fingers 113 formed to project through openings 111 and holes 109 into the path of movement of side edges 108. A rivet 114' holds strip 112 to strip 110. A portion of plate 48*a* is cut out to avoid contact with rivet 114'.

Strip 112, and thus its fingers 113, is connected by a lead 114 to one input terminal of generator 100. Another lead 115 connects from generator 100 to one of ears 105. Since all of plate 48*a*, springs 107 and bracket 50 are metallic, a conductive path extends from lead 115 to side edges 108. When knob 24 is slightly twisted to move a side edge 108 over a hole 109, that side edge 108 electrically contacts a corresponding finger 113. This action effects a connection between leads 114 and 115 so as to provide an input signal to generator 100. FIG. 8 shows the switch parts in a non-contact position, while FIG. 9 depicts one lug 106 in contact with a finger 113.

Figure 10:
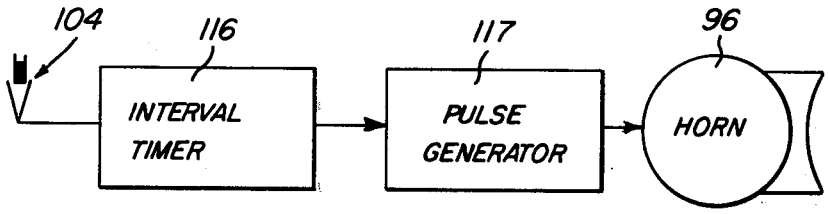
FIG. 10 is a block diagram of alarm system circuitry.

Sound generator 100 takes advantage of the miniaturization of digital electronics so as to be entirely contained on a comparatively small printed circuit board in the form of substrate 101. A block diagram of the desired circuitry is shown in FIG. 10. Thus, actuation of displacement switch 104 activates an interval timer 116 which, in turn, operates a pulse generator 117 that drives the transducer or alarm horn 96 with a succession of pulses. Interval timer 116 causes generator 117 to develop the sound signals only for a pre-determined period of time subsequent to which the generator resets itself for repeated responses to another input signal from switch 104. Moreover, generator 117 continues development of the sound signal for that predetermined period of time entirely free of any further operation upon the lock mechanism. That is, even the unlocking of the door while the alarm is still sounding does not serve to disable the sounding of the alarm. This assists as against the intruder who does have a key but first "tries" the lock.

Figure 11:
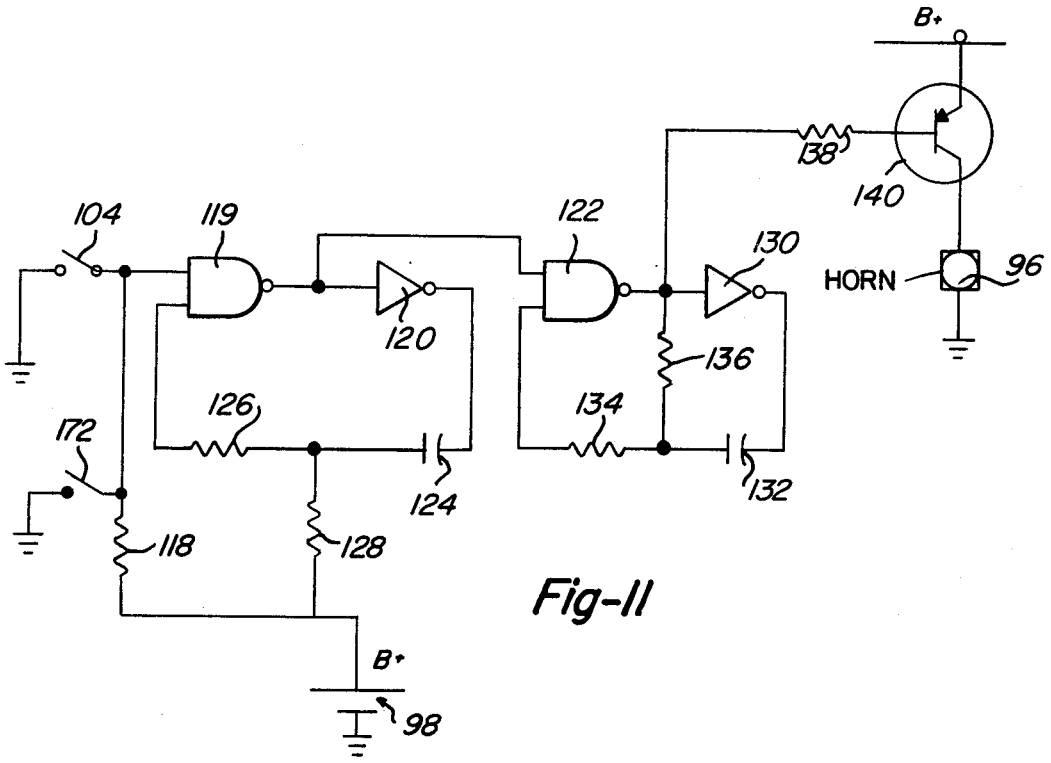
FIG. 11 is a schematic diagram of one embodiment of the circuitry in FIG. 10.

A first detailed circuit approach is depicted in the schematic diagram of FIG. 11. For development of the input signal, switch 104 is connected across a resistor 118 in series with battery 98. The junction between switch 104 and resistor 118 is connected to one input of a NAND gate 119 the output of which is connected both to the input of a NOT connective 120 and one input of a NAND gate 122. The output of NOT connective 120 is coupled through a capacitor 124 and a resistor 126 back to the other input of gate 119. The junction between capacitor 124 and resistor 126 is connected back to the positive terminal of battery 98 through a resistor 128. The input of gate 122 is connected to the input of a NOT connective 130 the output of which is coupled through a capacitor 132 and over a resistor 134 back to the other input of gate 122. A resistor 136 bridges the respective junctions between gate 122 and connective 130 and capacitor 132 and resistor 134. The junction between gate 122 and connective 130 also is connected over a resistor 138 to the base of a PNP transistor 140 the emitter of which is connected to the positive terminal of battery 98 and the collector of which is connected in series with horn 96 back to the negative side of battery 98.

Gate 119 and connective 120, together with the delay network composed of capacitor 124 and resistor 128, constitute a timing network which establishes a fixed period of alarm sounding regardless of the duration of closure of switch 104. During the alarm period, the pulse generator composed of gate 122 and connective 130 enables operation of transistor 140 by alternately turning the alarm on and off. The rate at which pulsations occur is established by the values of capacitor 132 and resistor 136 which create that network time constant. Desirably, the time constant is 100 milliseconds. That results in an alarm pulsation rate of approximately five hertz. Of course, different pulsation rates and operating periods can be established by selection of the appropriate values of resistors 136 and 128, respectively. Alternatively, generator 117 may be of a form, known in the art of electronic sirens, that produces a repetitive wailing sound.

Figure 12:
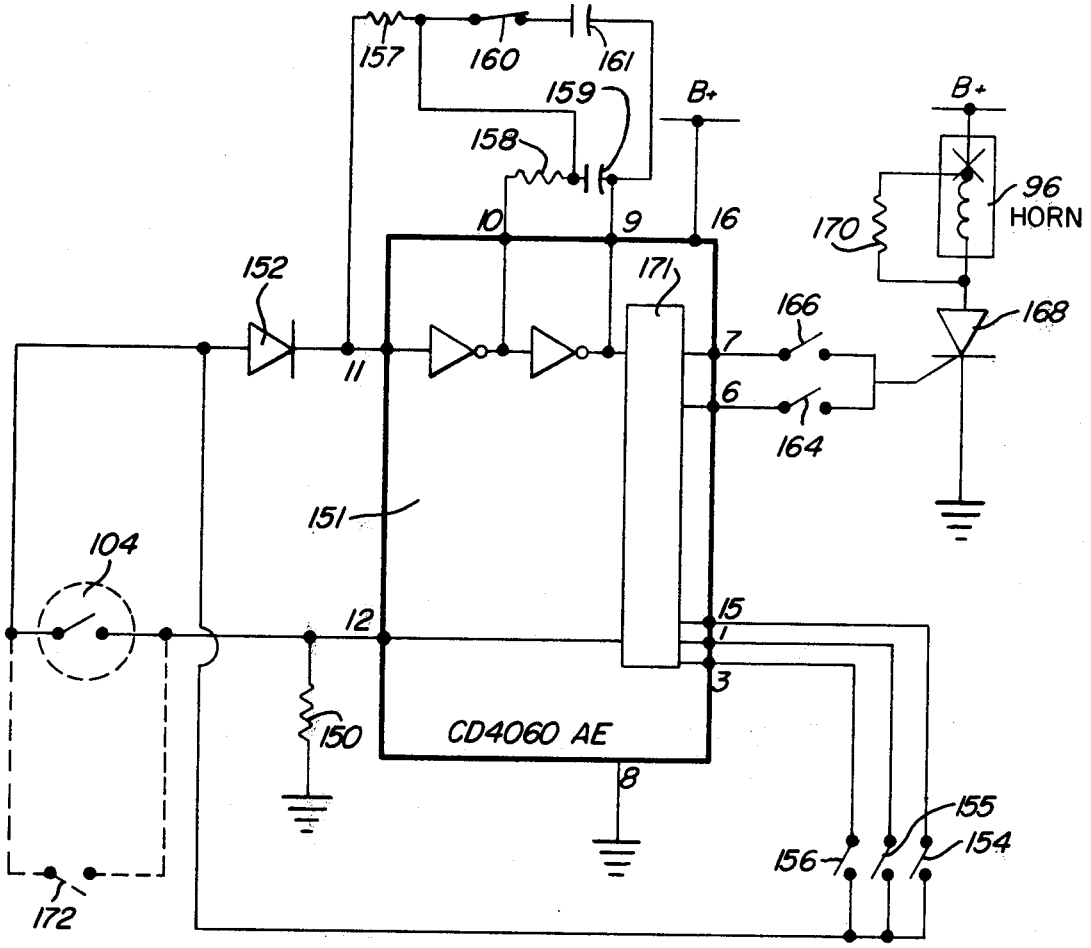
FIG. 12 is a schematic diagram of an alternative embodiment of alarm system circuitry.

Different circuitry is shown in FIG. 12. In this case, one side of switch 104 is returned to ground through a resistor 150 and also connected to the reset terminal "12" of a conventional CD4060AE integrated circuit 151. The other side of switch 104 is connected through a diode 152 to the input terminal "11" of integrated circuit 151. That same side of switch 104 is returned in parallel through each of switches 154, 155 and 156 respectively to output terminals "15", "1" and "3" of integrated circuit 151. The junction between diode 152 and input terminal "11" of integrated circuit 151 is connected through a resistor 157 to a junction between another resistor 158 and a capacitor 159 the respective other ends of each of which are connected to terminals "10" and "9" of integrated circuit 151. Bridging capacitor 159 is the series combination of a normally-closed switch 160 and another capacitor 161. In normal operation, resistor 158 and capacitor 161 establish a nominal operating frequency of an oscillatory signal to be further discussed. As also will be further discussed, however, opening of switch 160 effectively results in the substitution of capacitor 159 for capacitor 161 and the production of a different operating frequency. To those ends, capacitor 159 has a value much less then that of capacitor 161. Power is supplied to terminal "16" from the positive terminal of battery 98 and the negative return from integrated circuit 151 is from its terminal "8". Signal output from integrated circuit 151 is secured from terminals "6" and "7" of integrated circuit 151 and fed through respective switches 164 and 166 in common to the gate electrode of a silicon-controlled rectifier 168 the cathode of which is connected to the negative side of battery 98 and the anode of which is fed through transducer or alarm horn 96 to the positive terminal of battery 98. A resistor 170 shunts the solenoid winding within the alarm horn. In this case, the alarm horn is of the vibratory type so as to disable SCR 168 after each pulse and thereby enable the SCR to deactivate after the end of the alarm sounding period. As very particularly embodied herein, switches 154, 155 and 156 permit selection as between alarm durations of 3.2 seconds, 12.8 seconds and 51 seconds, respectively.

Figure 13:
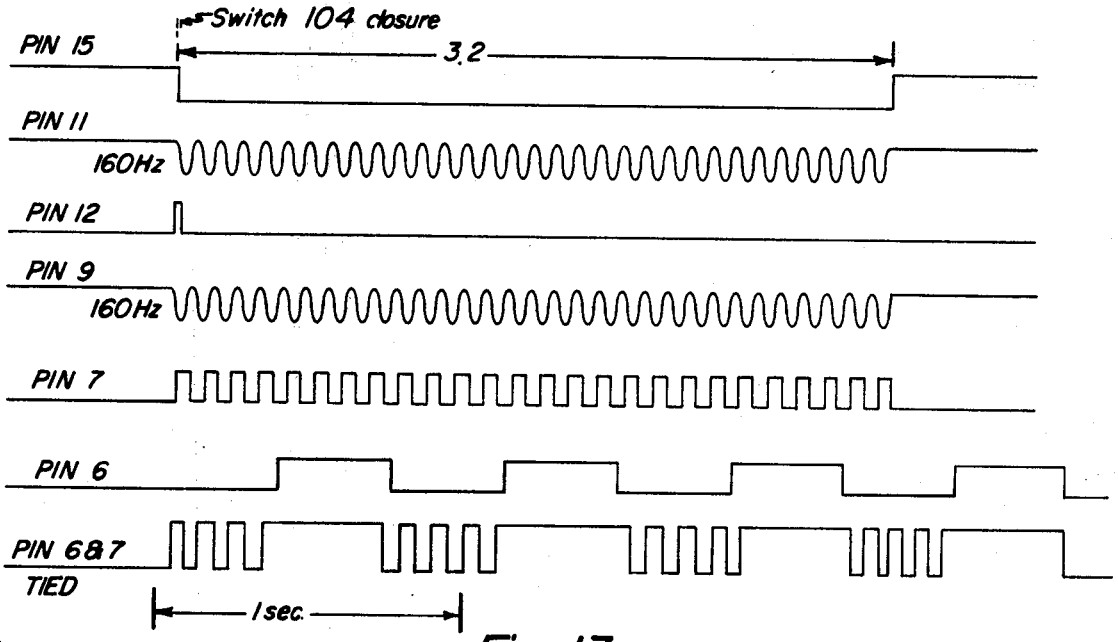
FIG. 13 is a timing diagram illustrating a mode of operation of the embodiment of FIG. 12.
Figure 15:
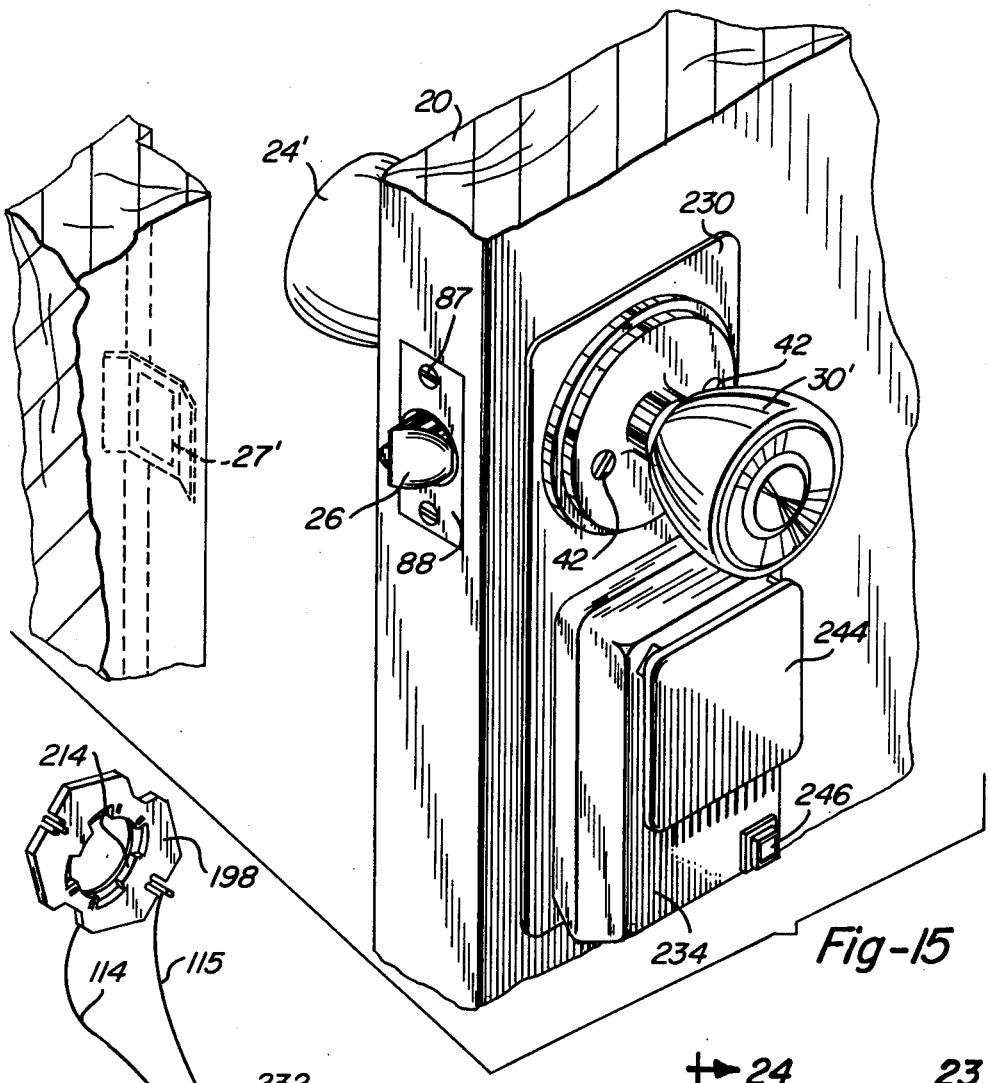
FIG. 15 is a view similar to FIG. 1 but illustrating an assembly of another embodiment of an intrusion alarm system.
Figure 17:
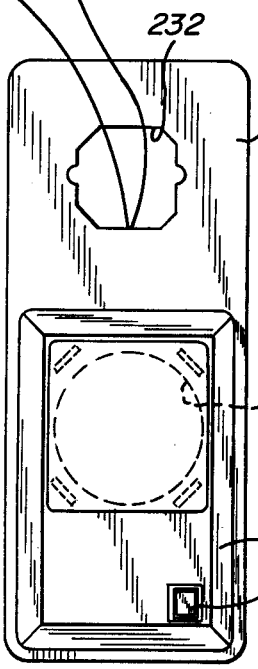
FIG. 17 is a front-elevational view of a portion of that shown in FIG. 15 removed from the door and with a sub-assembly pulled out for illustration.
Figure 16:
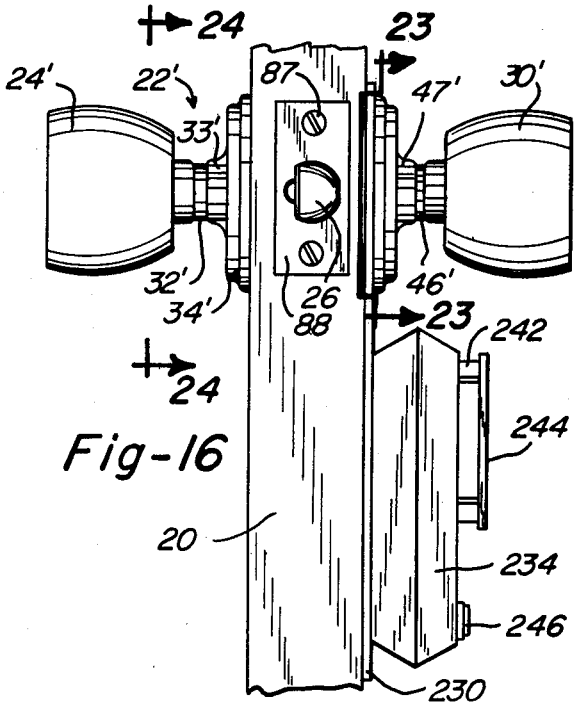
FIG. 16 is a fragmentary side-elevational view of the door and assembled alarm system as shown in FIG. 15.
Figure 18:
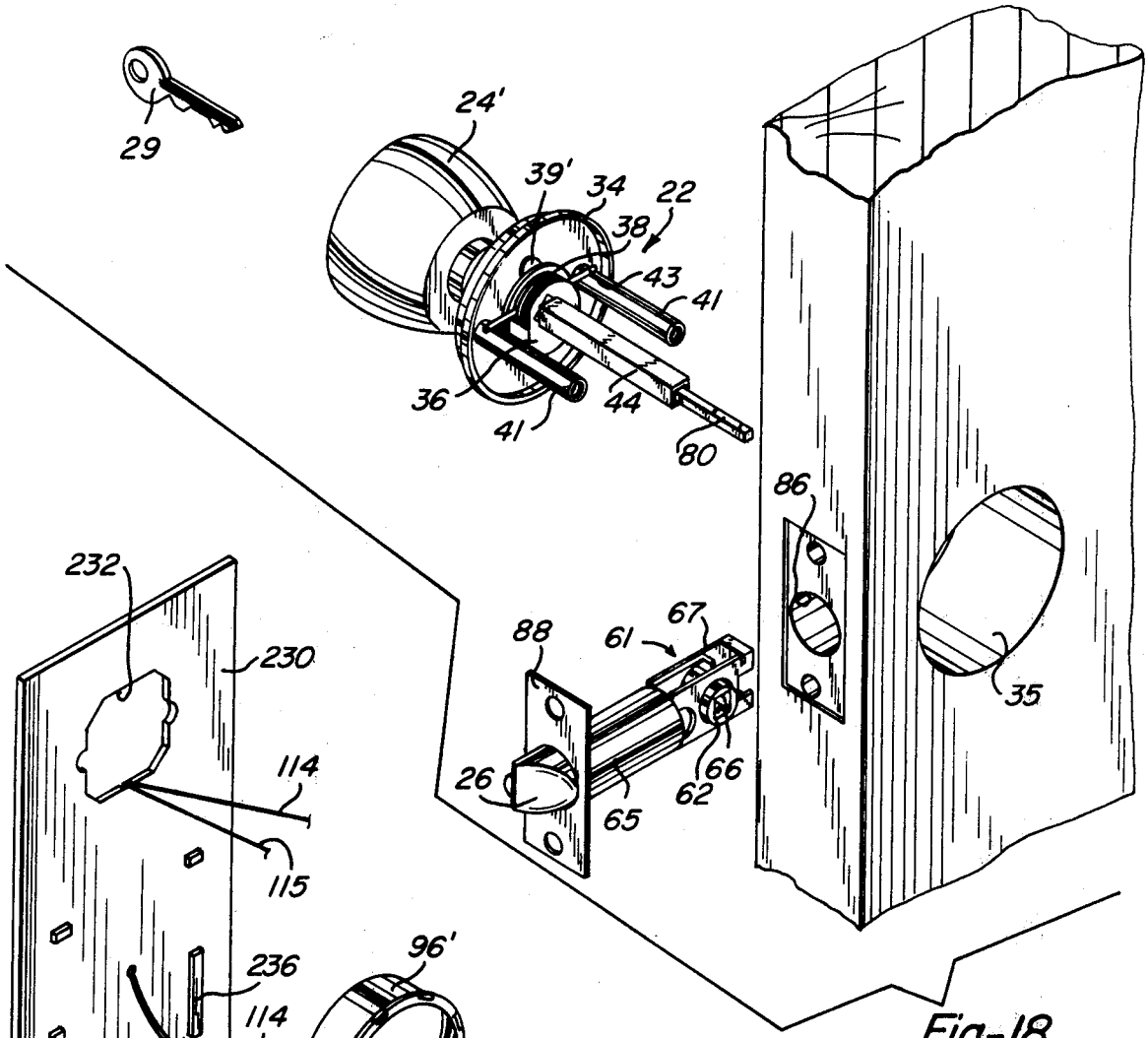
FIG. 18 is an exploded perspective view, similar to FIG. 4, of one side of the assembly shown in FIG. 15.
Figure 19:
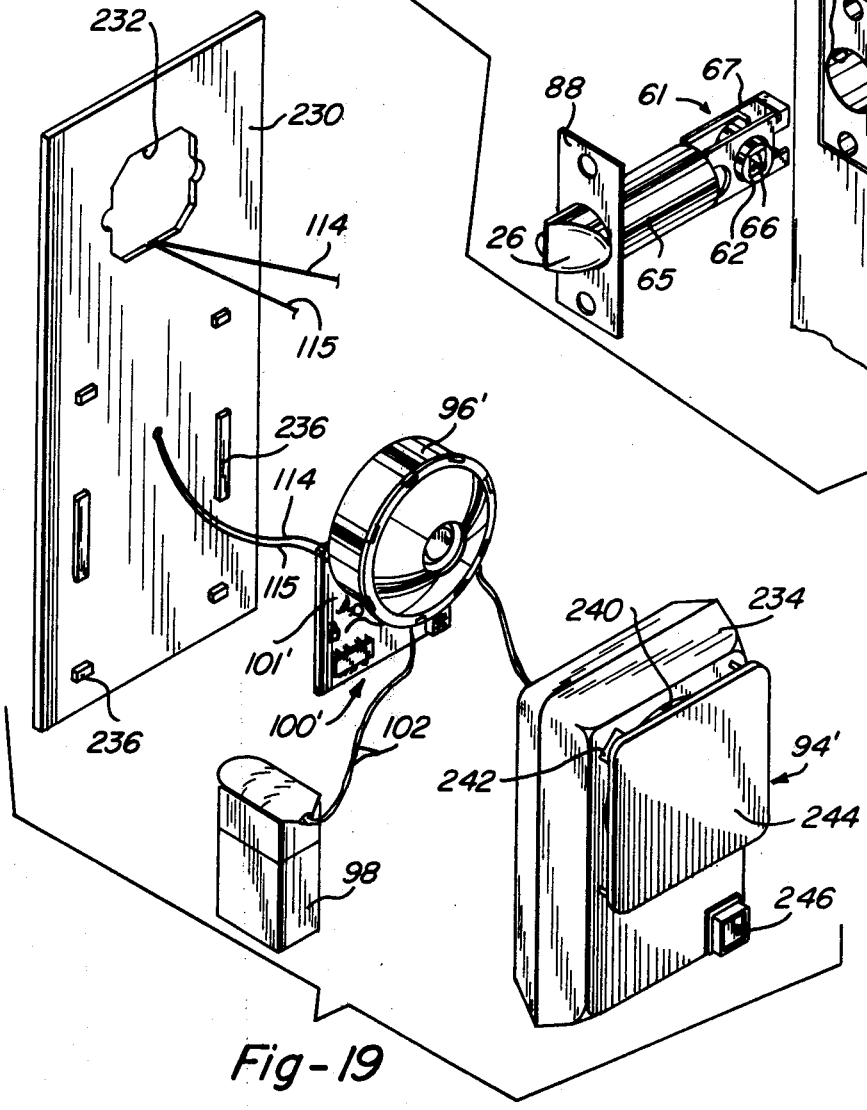
FIG. 19 is an exploded perspective view of a portion of the opposite side of that assembly.
Figure 20:
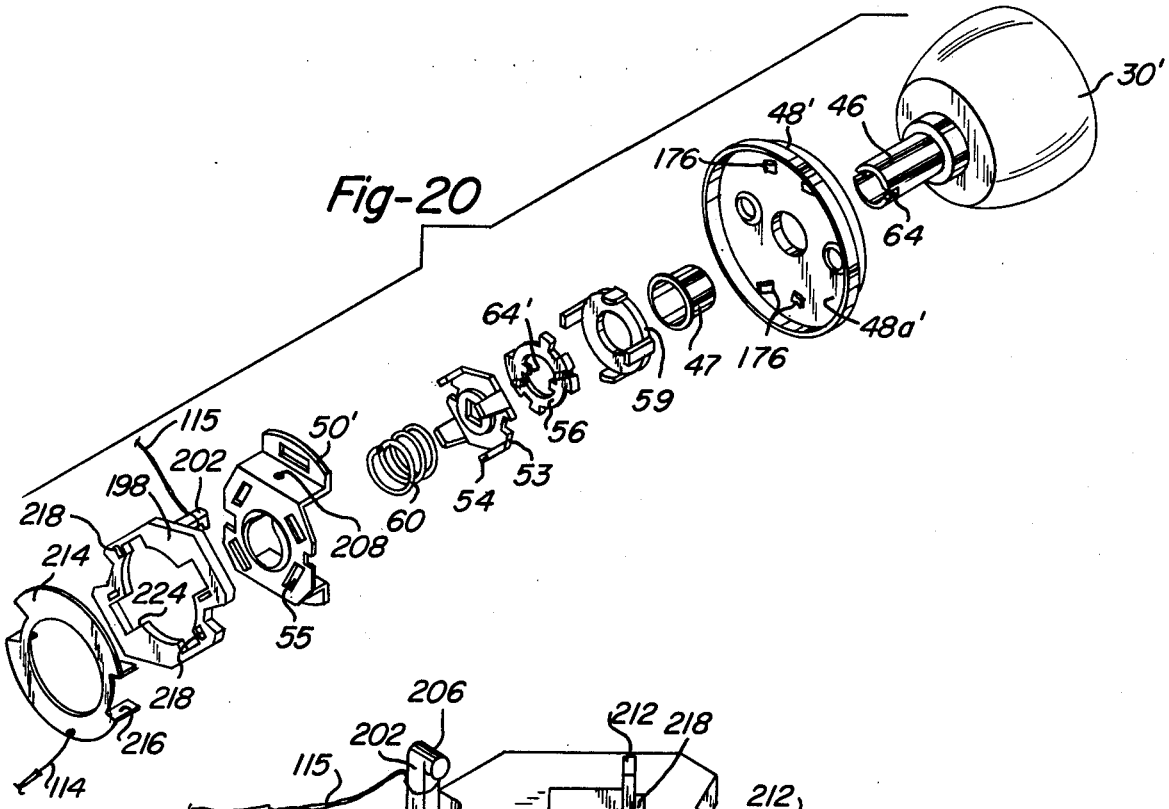
FIG. 20 is an exploded perspective view of another portion of the latter side of that assembly.
Figure 21:
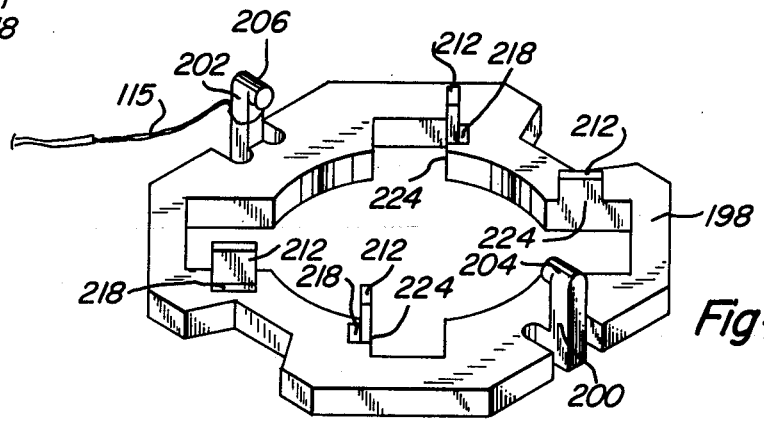
FIG. 21 is an enlarged perspective view of a component shown in FIG. 20.
Figure 22:
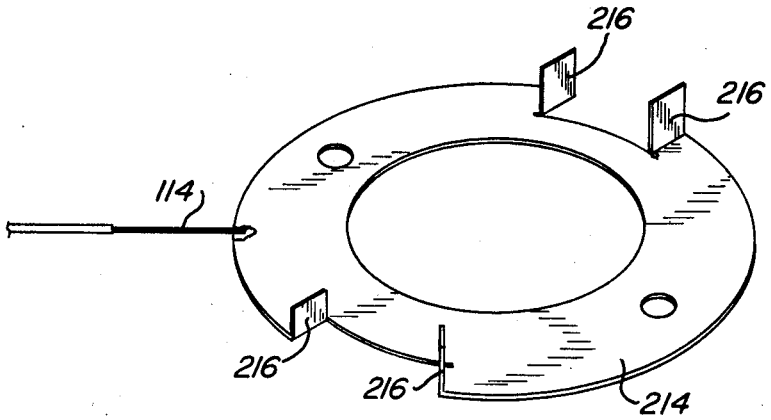
FIG. 22 is an enlarged perspective view of another component shown in FIG. 20.
Figure 23:
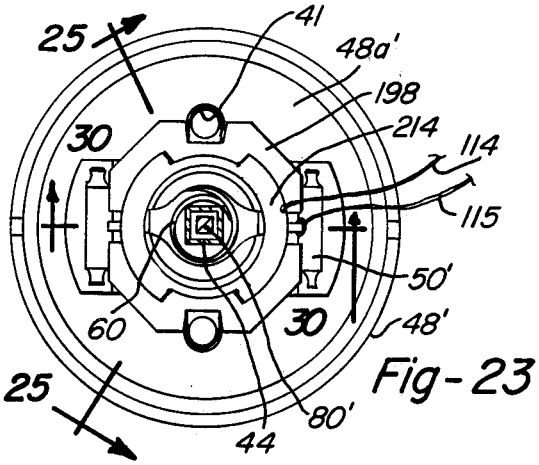
FIG. 23 is a cross-sectional view taken along the line 23—23 in FIG. 16.
Figure 24:
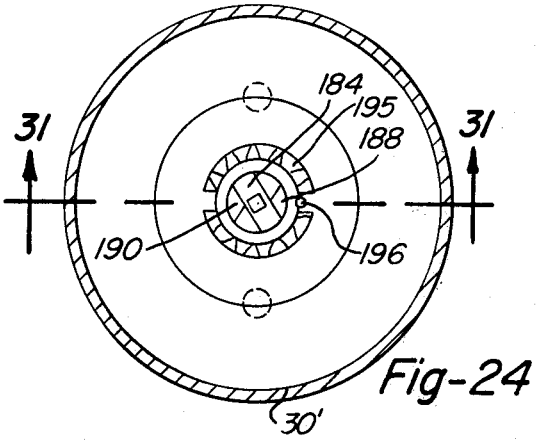
FIG. 24 is a fragmentary cross-sectional view taken along the line 24—24 in FIG. 16.

FIG. 13 depicts a timing diagram for an assumed relationship with switch 154 closed while switches 155 and 156 are open. As indicated, the operation of the fourteen-stage binary counter 171 included within integrated circuit 151, as normally governed by capacitor 161 in combination with resistor 158, is at the rate of one hundred-sixty Hertz and the resultant output sound signals have a period of somewhat more than one second for the case in which both of switches 164 and 166 are closed.

In actual implementation, the outputs from either or both of terminals "6" or "7" of integrated circuit 151 may be employed to control the occurrence rate of the alarm signal pulses and, as also indicated, switches 154, 155 or 156 may be activated to effect a change in duration. A type of truth table illustrating the various possibilities is depicted in FIG. 14.

In one further modification, a small pushbutton or other operator may project through the wall of escutcheon 90 and serve to activate a switch 172 for the purpose of manually testing the alarm from inside the door and regardless of whether the lockset is locked or unlocked. To that end, switch 172 is connected in parallel with switch 104 as shown in each of FIGS. 11 and 12. Such a pushbutton will be shown in an embodiment yet to be described.

The lockset and alarm combination shown in FIGS. 15–34 is basically the same as that of FIGS. 1–9 except for a preferred modification as represented by displacement switch 104'. The latter may be substituted for switch 104 wherever mentioned above. Knob 24' and the remainder of the lockset outside the door 20 are essentially the same as already described with respect to the version of FIGS. 1–9. Primes are used in numbering to indicate similar parts. In this embodiment, however, bracket 50' is directly staked to the inner side of cover plate **48*a'* by means of prongs 176. Thus, bracket 50' does not rotate relative to mounting plate 48*a'***.

Figure 25:
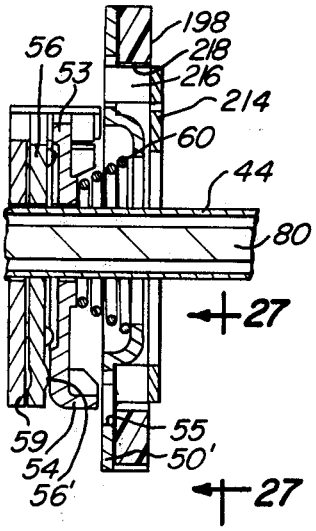
FIG. 25 is a fragmentary cross-sectional view taken along the line 25—25 in FIG. 23 and showing a positioning of certain parts so as to achieve an open condition of an included lock mechanism.
Figure 27:
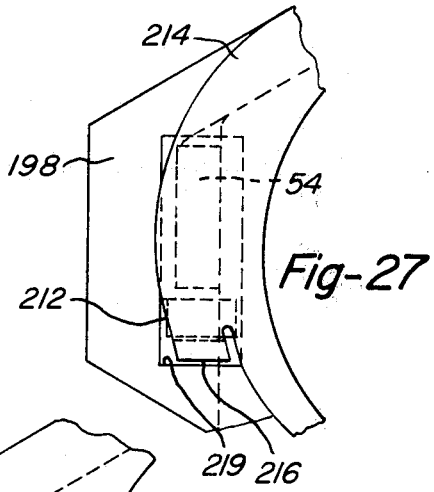
FIG. 27 is an enlarged fragmentary elevational view taken along the line 27—27 in FIG. 25.
Figure 26:
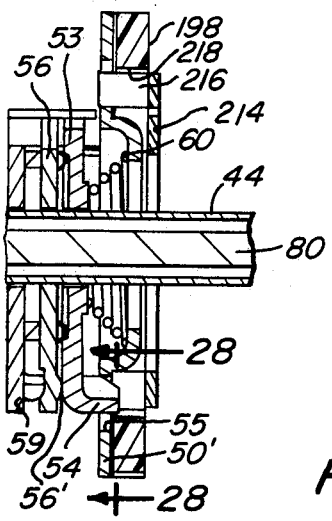
FIG. 26 is a cross-sectional view similar to FIG. 25 but with those parts repositioned to establish a locked condition.

In particular, the inner side of the lockset, associated with knob 30', is also similar to that described earlier insofar as the door opening and locking functions are concerned. Thus, operation again involves projections 54 on locking plate 53 that enter openings 55 in bracket 50' to achieve the actual locking of latch bolt 26. FIG. 25 shows the unlocked condition, while FIG. 26 shows the locked condition. In this case (FIGS. 31–34), lockshaft 80 is received within a mating opening 180 in a bushing 182 which has a necked-down lug 184 received within a bearing 186. Lug 184 is seated between internal nubs 188 and 190 each of which has radially-angled faces 192 and 194 that limit the degree of rotation in either direction of bushing 182. Bearing 186 and its included bushing 182 seat within shank 46 which indirectly is staked as at 195 to the interior of knob 30'. Bearing 186 is secured by a pin 196 received within a slot 197.

Figure 28:
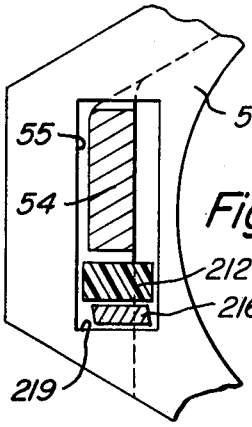
FIG. 28 is an enlarged fragmentary cross-sectional view taken along the line 28—28 in FIG. 26 and shows an open-switch condition.

Affixed on the opposed surface of bracket 50' is an insulator ring 198 snapped into place by means of flexible legs 200 and 202 which have respective toes 204 and 206 engageable in corresponding openings 208 and 210 in the opposing legs of bracket 50'. A plurality of ears 212 project inwardly from ring 198 into openings 55 in bracket 50'. Disposed against the exposed surface of insulator ring 198 is a conductive ring 214 which has a plurality of circumferentially-spaced tabs 216 that project a sufficient distance through correspondingly-spaced openings 218 in ring 198 so as to lie against the corresponding sides of ears 212 and also project into openings 55. In that latter position, tabs 216 normally are spaced a very short distance apart from the end margins 219 of each of the respective ones of openings 55 (FIG. 28). Spaced circumferentially opposite each of ears 212 from openings 218 is a corresponding recess 224. Each recess 224 is located and sized to seat a respective one of lugs 54 when the latter projects through its opening 55 during the locked condition.

Figure 29:
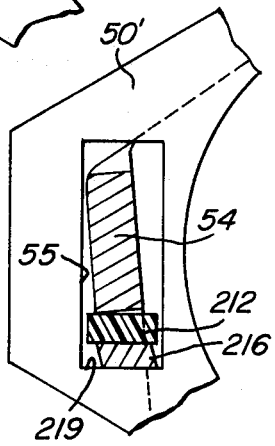
FIG. 29 is a view similar to FIG. 28 but with certain components in a different position for a closed-switch condition.
Figure 30:
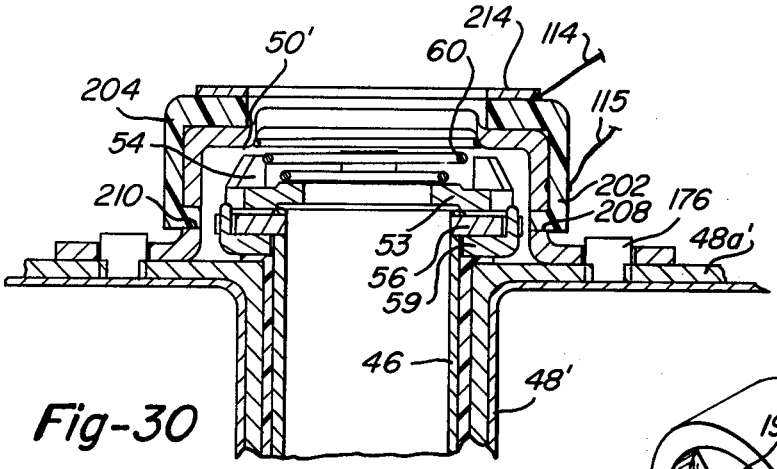
FIG. 30 is a fragmentary cross-sectional view taken along the line 30—30 in FIG. 23.
Figure 32:
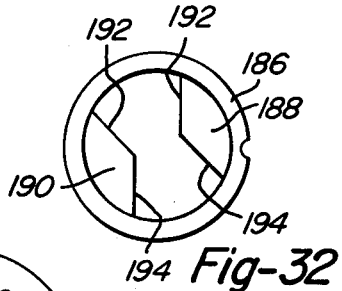
FIG. 32 is an enlarged plan view of a component shown in FIGS. 24 and 31.
Figure 33:
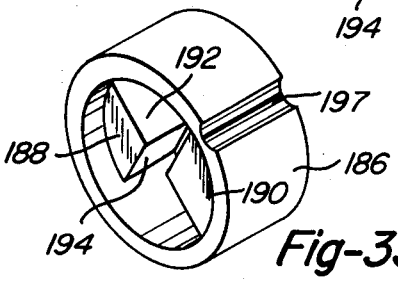
FIG. 33 is a similarly-enlarged perspective view of the component shown in FIG. 32.
Figure 31:
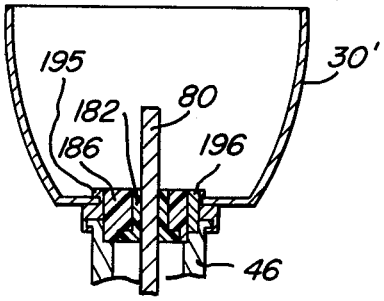
FIG. 31 is a cross-sectional view taken along the line 31—31 in FIG. 24.
Figure 34:
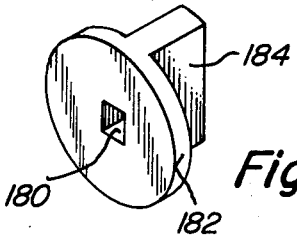
FIG. 34 is an enlarged perspective view of an element also shown in FIGS. 24 and 31 and associated with the component shown in FIGS. 32 and 33.

In use, tabs 216 become one side of switch 104', while end margins 219 of openings 55 become the other side of the switch. Accordingly, lead 114 runs from conductive ring 214 and lead 115 is effectively connected to bracket 50' as by being secured around leg 202 which seats against the bracket. The two leads, of course, feed the electronic circuitry, as before. In operation, only a slight twist on knob 24, and hence upon shaft 44 when the lockset is locked, effects a correspondingly slight rotation of locking plate 53 so as to urge lugs 54 against one or the other of the end margins of recesses 224 which extend through insulator ring 198 over the corresponding positions of openings 55. The pressure of a lug 54 against any end margin of any recess 224 is thus against the surface of an ear 212 opposite a tab 216. That causes a very slight rotation of insulator ring 198 as permitted by the flexibility of legs 200 and 202, and that rotation of ring 198 and movement of an ear 212 is sufficient to close that tab 216 against the end margin 219 of an opening 55 and thereby complete the switch closure (FIG. 29).

On the other hand, the combination of bushing 182 and bearing 186 enables lockshaft 80 to be operated by means of a key inserted within lock cylinder 82 so as to unlock inner knob 30' and thereby disarm or deactivate the alarm mechanism. That is, operation of lockshaft 80 releases knob 30' under the urging of spring 60 so that projections 54 are pulled out of openings 55 and thus removed from any kind of possible contact with the walls of recesses 224. Bushing 182 and bearing 186 cooperate to insure freedom of rotation of lockshaft 80 to turn knob 30', upon use of key 29 to unlock the mechanism, without mechanical coupling or feedback to shaft 44 that otherwise might cause undesired alarm initiation. Thus, bushing 182 and bearing 186 in this case are substituted for the conventional cross-plate ordinarily within knob 30' as mentioned above for knob 30.

In the version of FIGS. 15-34, a mounting plate 230 lies flat against the interior surface of door 20 and has an opening 232 through which rings 198 and 214 along with bracket 50' project. An escutcheon 234 is snapped into place on mounting plate 230 by means of engagement between its inner wall margins and lugs 236 which project outwardly from plate 230. All of interval timer 116, pulse generator 117 and alarm horn 96' are carried upon a circuit board 101' which, in turn, is mounted within escutcheon 234 as is battery 98. When using the circuitry of FIG. 12, switches 154-156, 164 and 166 also are carried on board 101'. In this case, the sound outlet grill 94' is in the form of an opening 240 spaced outwardly from which by legs 242 is a cover 244. Cover 244 preferably is dimensioned to exhibit flexual-mode resonance at the preferred sound frequency. Also projecting through the outer wall of escutcheon 234 is a pushbutton 246.

As adverted to above, pushbutton 246 may be associated with and operate switch 172 in order to provide manual testing of the alarm. Alternatively, or with the addition of a second pushbutton or the like, pushbutton 246 may be associated with and operate switch 160 in order to squelch or deactivate alarm operation after a test or an unintended initiation. As shown in FIG. 12, switch 160 is normally closed and serves to connect capacitor 161 as a timing element, so that the oscillation frequency is about one hundred-sixty Hertz. Under those conditions, the alarm is sounded for the completed operating period selected. When, however, switch 160 is opened as by depression of an associated pushbutton, the oscillator is caused to cycle at a much faster rate, preferably about five hundred times faster, because capacitor 159 is proportionately of that much lesser value than capacitor 161. By reason of the increase in the cycle rate of the oscillator, the alarm period is effectively compressed to about one five-hundredth of normal. Assuming, for example, a selected normal alarm duration of about one minute, the opening of switch 160 would result in a "cancelling" of the alarm after opening of switch 160 for only about 0.12 second. While this cancellation or squelch function corresponds to a resetting operation, it is achieved by accelerating the oscillator action.

Figure 35:
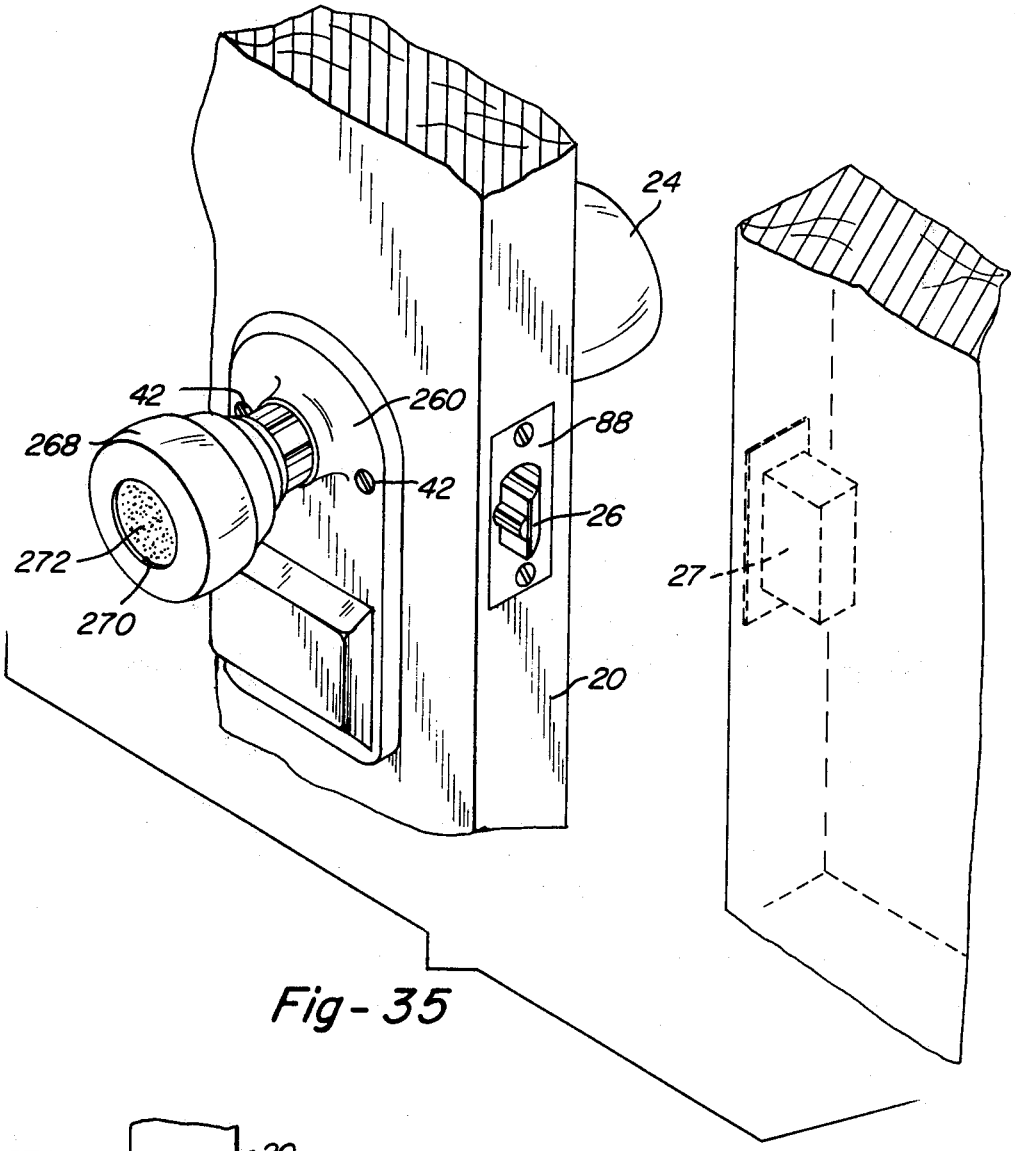
FIG. 35 is a view similar to those of FIGS. 1 and 15, although from a different perspective, and showing an assembly with a still further embodiment of an intrusion alarm system.
Figure 36:
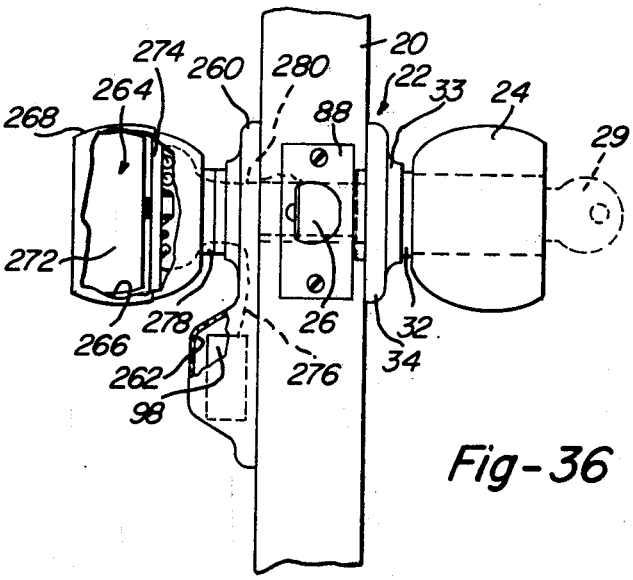
FIG. 36 is a fragmentary side-elevational view, partially broken away, of a portion of the apparatus shown in FIG. 35.

The mechanical approaches as thus far described are presently preferred, because they appear to be most readily adapted to a wide variety of different conventional locksets. Nevertheless, different distributions of the various components are contemplated, including greater customization of the lockset to reduce overall size of the total system. In FIGS. 35 and 36, for example, door 20 is fitted with at least basically the same latch assembly 22 together with a normally exterior knob 24 and an internal lock mechanism. Again, the lock mechanism includes a latch bolt 26 and is adapted to include switch 104 or 104'. The mechanical operation and manner of locking of the latch assembly is the same as has already been described.

In this case, however, an escutcheon 260 on the inside of door 20 is smaller than the escutcheons previously described, because its internal cavity 262 only contains a battery 98. Sound generator 264 is disposed within a cavity 266 defined by the interior of an internal knob 268. Knob 268 also includes an opening 270 behind which is disposed a transducer or alarm horn 272 for delivering the audible warning signal. Mounted on the back of horn 272 is a circuit board 274 upon which is carried integrated circuitry which embodies the features of the diagrams shown in either FIG. 11 or FIG. 12. That circuitry is powered from battery 98 through a pair of leads as indicated by dashed line 276. The leads extend beneath escutcheon 260 and through an appropriate circumferentially-limited slot in the side wall of the shank 278 of knob 268. As indicated by dashed line 280, the circuitry also is connected to switch 104 or 104'.

Battery 98 might also be disposed within cavity 266. However, presently-available battery sizes are such, in connection with the demand which must be met for adequately operating the transducer or alarm horn, that it appears desirable to use a battery of slightly larger physical size than that which would fit within the space allowable within a doorknob of conventional size. In addition, the battery has to be replaced from time to time. Thus, knob 268 would have to be more especially designed in order to allow for easy replaceability of the battery. In that connection, it is to be noted that either escutcheon 90 (FIG. 1) or escutcheon 260 may include an openable door or other access for permitting direct battery replacement without removing the escutcheon. In the two versions as illustrated, screws 42 must be temporarily removed so as to withdraw the escutcheon from the door and permit battery replacement.

It will thus be seen that security alarms have been disclosed which are of a type capable of being integrated into a standard residential lockset. The approach is that of providing an early-warning pre-entry notifier. It is especially intended for residential security, although it clearly is not limited to residential uses. Adaptability is particularly indicated with respect to doors which have standard key-in-knob types of locksets. The arrangements are such that the alarm apparatus is in no way responsive to the exertion of force upon the door or other closure. Instead, it contemplates response to that which is believed most likely to indicate an intent to intrude—the "trying" of the door. At the same time, this indication is given prior to the occurrence of the actual intrusion.

Preferably, the pulsation rate of the transducer or horn is selected to be that which is readily discernable and yet which is different from other alarm devices such as those designed to detect smoke or fire. Different doors may be assigned different rates so as to distinguish one from another. In addition, selective adjustment preferably is included so as to enable the user to choose a total duration of alarm which is consistent with his ability to be awakened in case he is sleeping. The nature of the apparatus is such as to enable it to be readily installed in direct replacement, and without modification to his doors or other closures, of existing conventional locksets.

As embodied, the physical mechanisms contemplate only a very slight rotation of the exterior doorknob as the intended intruder seeks to determine whether the door is locked. That amount of rotation of the doorknob preferably would be of the order of plus or minus three degrees of rotation. The circuitry is of a kind which, when the alarm is not sounding, consumes so little power from the battery that a battery life of greater than one year should be assured.

Another advantageous feature is that, when the door is unlocked, the security alarm automatically is deactivated or disarmed. However, whenever the door is locked, the alarm is armed or activated for operation.

The switch mechanisms are such that an attempt to apply force to the exterior doorknob in either direction will set off the timed alarm. In re-arming itself after a fixed period of time, the alarm provides continued protection during the absence of a person residing within the enclosure. That is, and assuming that actuation of the alarm drives the intended intruder away from the premises, the alarm resets itself for a subsequent attempt by the same or a different would-be intruder.

A separate switch may enable the alarm to be tested from inside even when the alarm is in the locked position. A different switch may also provide squelching of the alarm after it has begun to sound. It is important to note that the security arrangement is not sensitive to forces exerted on the latch bolt itself. Pressure upon the door will not set off the alarm. That guards against the effect of wind or other inadvertent pressure.

While particular embodiments of the invention have been shown and described, and other modifications have been indicated, it will be obvious to those skilled in the art that changes and modifications may be made without departing from the invention in its broader aspects, and, therefore, the aim in the appended claims is to cover all such changes and modifications as fall within the true spirit and scope of the invention.

It is claimed:

1. In an intrusion alarm system:

a closure having a latch assembly that includes a knob on one side of said closure for enabling opening of said closure as a result of operation of said assembly, said operation requiring physical action by a person with respect to said knob;

a lock mechanism included within said knob and selectively operable to lock or unlock said latch assembly;

an alarm apparatus associated with said latch assembly and disposed on the side of said door opposite said one side, said alarm apparatus including a battery, a generator powered by said battery and responsive to an input signal for developing a sound signal, and a transducer responsive to said sound signal for delivering an audible warning signal;

means responsive to said physical action for delivering said input signal to said generator when said latch assembly is in a locked condition of said lock mechanism;

and said responsive means being effectively disabled when said latch assembly is in an unlocked condition of said lock mechanism.

2. A system as defined in claim 1 which further includes means for arming and disarming said responsive means respectively in correspondence with locking and unlocking of said latch assembly.

3. A system as defined in claim 1 in which said responsive means includes a switch operable to develop said input signal in response to physical movement of said knob.

4. A system as defined in claim 3 in which said switch is operated by a portion of said lock mechanism.

5. A system as defined in claim 4 in which said switch includes a member rotatable by a portion of said lock mechanism to effect closure of the electrical contacts of said switch.

6. A system as defined in claim 5 in which said member is electrically conductive and serves as an electrical contact.

7. A system as defined in claim 5 in which said member is electrically insulative and, upon rotation, moves an electrical contact into engagement with another electrical contact.

8. A system as defined in claim 5 which further includes means for resiliently biasing said member to a rotational position in which said contacts are mutually disengaged.

9. A system as defined in claim 3 in which said knob is rotatable in operation of said latch assembly, in which rotation of said knob more than a minor fraction of a revolution thereof is prevented under said locked condition, and in which said switch operates in response to rotation of said knob only a minor fraction of a revolution thereof.

10. A system as defined in claim 1 in which said latch assembly includes a second knob on the side of said closure opposite said one side and which further includes an escutcheon associated with said second knob and enclosing at least a portion of said alarm apparatus.

11. A system as defined in claim 10 in which said escutcheon includes a sound-transmissive grill, and in which said transducer is mounted within said escutcheon behind said grill.

12. A system as defined in claim 1 in which said battery and said generator also are mounted within said escutcheon.

13. A system as defined in claim 1 in which said latch assembly includes a second knob on the side of said door opposite said one side, and in which a portion of said alarm apparatus is disposed inside said second knob with the latter having an outlet for sound developed by said transducer.

14. A system as defined in claim 13 which further includes an escutcheon associated with said second knob, in which said battery is disposed within said escutcheon, and in which said generator and said transducer are disposed within said second knob.

15. A system as defined in claim 1 in which, in response to said input signals, said sound generator develops a succession of pulses of said sound signals, and which further includes means for manually selecting the occurrence rate of said pulses.

16. A system as defined in claim 1 in which, upon receipt of said input signal, said generator continues the development of said sound signals only for a pre-determined period of time subsequent to which said generator resets itself for repeated response to another such input signal.

17. A system as defined in claim 1 which includes means for deactivating said alarm apparatus automatically upon unlocking of said lock mechanism and activating said alarm apparatus automatically upon locking of said lock mechanism.

18. A system as defined in claim 1 in which said responsive means includes a portion of said lock mechanism.

19. A system as defined in claim 1 which further includes means disposed on the side of said closure opposite said one side for selectively testing operation of said alarm apparatus.

20. A system as defined in claim 1 in which, upon receipt of said input signal, said generator continues development of said sound signal for a pre-determined period of time and free of any operation of said lock mechanism.

21. A system as defined in claim 1 in which said alarm apparatus is unresponsive to the exertion of force upon said closure.

22. A system as defined in claim 1 which further includes manually operable means disposed on the side of said closure opposite said one side for effectively deactivating said generator subsequent to activation thereof by said input signal.

23. A system as defined in claim 22 in which said generator includes an oscillator operational normally for a selected time period, and in which said deactivating means increases the cycle rate of said oscillator to decrease said time period.

24. For use in an intrusion alarm system, a lockset having a latch bolt reciprocable to latch and unlatch a closure, a shaft mounted in said closure and movable to effect reciprocation of said latch bolt, means coupled between said latch bolt and said shaft for reciprocating said latch bolt in response to movement of said shaft, and the improvement comprising:

a pair of electrical contacts mounted with respect to said shaft for relative movement into and out of mutual engagement;

means for establishing a pair of current-conducting paths individually leading from respective different ones of said contacts;

means responsive to said movement of said shaft for effecting said relative movement of said contacts;

means for locking said shaft against said movement thereof in an amount sufficient to effect unlatching of said closure by said latch bolt;

and means for effecting said relative movement of said contacts into said mutual engagement upon the initiation of said movement of said shaft when in a locked condition.

25. A lockset as defined in claim 24 which further includes means for locking said shaft against effective reciprocation of said latch bolt; and which also includes means for disabling said relative movement of said contacts into said mutual engagement when said shaft is unlocked.

26. A lockset as defined in claim 24 which further includes means for locking said shaft against effective reciprocation of said latch bolt; and which also includes means for enabling said relative movement of said contacts into said mutual engagement only when said shaft is locked.

27. A lockset as defined in claim 24 which further includes a locking mechanism and a member rotatable by a portion of said mechanism to effect closure of said contacts.

28. A lockset as defined in claim 27 in which said member is electrically conductive and serves as one of said contacts.

29. A lockset as defined in claim 27 in which said member is electrically insulative and, upon rotation, moves one of said contacts into engagement with the other.

30. A lockset as defined in claim 27 which further includes means for resiliently biasing said member to a rotational position in which said contacts are mutually disengaged.

* * * * *